US005387892A

United States Patent [19]

Rossetti et al.

[11] Patent Number: 5,387,892

[45] Date of Patent: Feb. 7, 1995

[54] PERMANENT MAGNET RELEASE SOLENOID FOR AUTOMATIC CIRCUIT BREAKERS AND METHOD OF MAKING

[75] Inventors: Gian P. Rossetti, Cremona; Augusto Contardi, Varese, both of Italy

[73] Assignee: Bticino S.P.A., Milan, Italy

[21] Appl. No.: 983,576

[22] PCT Filed: Jul. 29, 1991

[86] PCT No.: PCT/EP91/01424

§ 371 Date: Mar. 30, 1993

§ 102(e) Date: Mar. 30, 1993

[87] PCT Pub. No.: WO92/02944

PCT Pub. Date: Feb. 20, 1992

[30] Foreign Application Priority Data

Jul. 30, 1990 [IT] Italy ..... 21117-A/90

[51] Int. Cl.[6] ..... H01F 7/00; H01F 7/06

[52] U.S. Cl. ..... 335/254; 335/234; 29/607

[58] Field of Search ..... 335/229, 230, 234, 254, 335/179, 251; 29/592.1, 607

[56] References Cited

U.S. PATENT DOCUMENTS

| | | | |
|---|---|---|---|
| 3,886,507 | 5/1975 | Johnson et al. | 335/234 |
| 4,443,775 | 4/1984 | Fujitani et al. | 335/251 |
| 4,595,896 | 6/1986 | DiMarco et al. . | |
| 4,660,012 | 4/1987 | Bonniau et al. | 335/234 |
| 4,684,309 | 8/1987 | Horn | 414/224 |
| 4,876,521 | 10/1989 | Boyd . | |

FOREIGN PATENT DOCUMENTS

| | | |
|---|---|---|
| 0180537 | 5/1986 | European Pat. Off. . |
| 0187055 | 7/1986 | European Pat. Off. . |
| 0305321 | 3/1989 | European Pat. Off. . |
| 26187 | 10/1963 | Germany . |
| 3323370 | 1/1985 | Germany . |

*Primary Examiner*—Leo P. Picard
*Assistant Examiner*—Stephen T. Ryan
*Attorney, Agent, or Firm*—Sheridan Ross & McIntosh

[57] ABSTRACT

The solenoid (1) is of the type having a magnetic circuit (2, 3, 13) on which a permanent magnet (6) and an electric winding (7) would induce respective magnetic fields; the magnetic circuit has a stationary portion including a squared annular shroud (2) divided theta-like by a partition (3) which encloses, between itself and the shroud (2), the permanent magnet (6), on the one side, and the electric winding (7), on the other side, and a moving portion including a plunger (13) slidable axially within the winding (7) and being guided through an opening (12) in the shroud (2). The plunger (13) is movable between a retracted position and an extended position dependent on the magnetic field induced by the winding (7). The partition (3) comprises a flat plate on which the plunger (13) bears directly in its retracted position.

1 Claim, 2 Drawing Sheets

Figure 1:
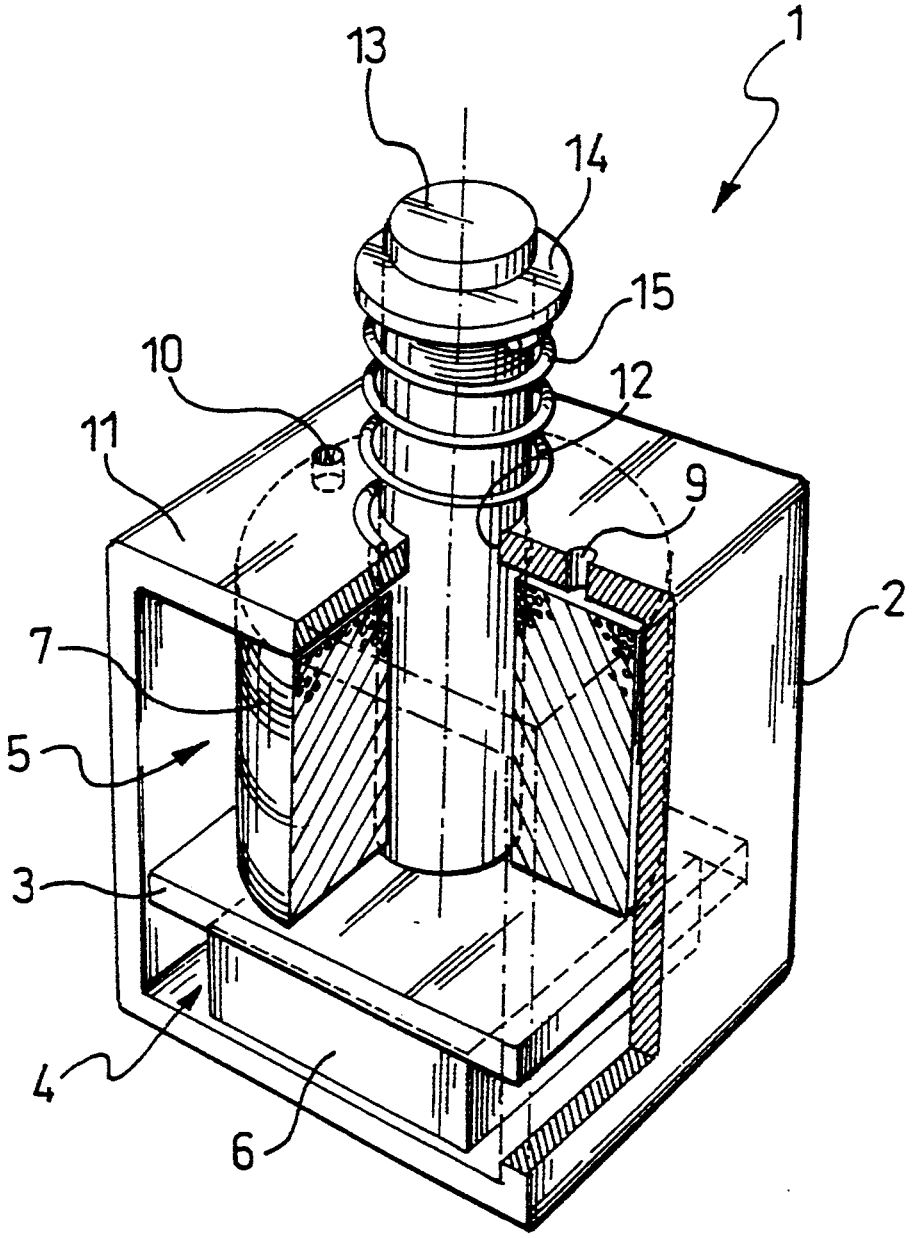

PERMANENT MAGNET RELEASE SOLENOID FOR AUTOMATIC CIRCUIT BREAKERS AND METHOD OF MAKING

DESCRIPTION

This invention relates to a permanent magnet release solenoid for automatic circuit breakers, which has a magnetic circuit whereon a permanent magnet and an electric winding would induce respective magnetic fields.

In particular, the invention relates to a solenoid of the type wherein the magnetic circuit comprises a stationary part including a squared annular shroud which is divided theta-like by a partition enclosing, on the one side, the permanent magnet, and on the other side, the electric winding, between itself and the shroud, and a moving part including a small plunger being slidable axially within the winding and guided through an opening in the shroud, the plunger being movable between a retracted position and an extended position dependent on the magnetic field induced by the winding.

In the retracted position, the plunger is magnetically coupled to both the shroud (through the opening being dimensioned to minimize the gap around the plunger while still allowing the plunger to slide) and the partition; the last-mentioned coupling is usually accomplished by means of a cylindrical lug formed integrally with the partition and having the same cross-sectional dimension as the plunger, with the plunger being arranged to bear on said lug. The bearing area between the plunger and the lug forms a break in continuity and, hence, a disturbance in the magnetic field; accordingly, care is taken to locate this discontinuity in the middle of the winding, where the substantially straight, magnetic flux lines will lie perpendicularly to the discontinuity and, therefore, not be liable to distortion.

In this way, however, the partition becomes quite expensive to make, because of the need to start with a blank of comparatively large size and machine it down until the lug is left proud.

Furthermore, during the assembly stage, it is impossible to fit all the parts, one after another, separately into the shroud from one of the open sides; at least the partition and winding must be pre-assembled together, and then the assembled parts fitted into the shroud, while in extreme cases, the various parts may have to be fitted in with the shroud in the open condition, and the shroud be closed again at the end of the operation. This affects assembly costs considerably.

It is the object of this invention to provide a solenoid of the type specified above, which can overcome the problems just outlined.

This object is achieved, according to the invention, by a solenoid as indicated being characterized in that the partition comprises a flat plate whereon the plunger is brought to bear directly in its retracted position.

It has been found, in fact, that by removing the lug from the partition altogether, and having the plunger bear directly on the partition, the distortions introduced in the magnetic field are in no way such as to hinder proper operation of the solenoid.

On the other hand, the partition can be here just a simple plate of minimal cost; in addition, with no lug to be fitted into the winding, the whole unit can be assembled with the shroud closed, and all the components fitted separately one after another, to cut down assembly time and cost.

In a second aspect, the invention relates to a method of making a solenoid as indicated, characterized in that it comprises the steps of, cutting off a tube length from a square cross-section stock of a ferromagnetic material;

making an opening through said tube length;

inserting, laterally into the tube length, an electric winding to a position adjacent to the opening;

inserting, laterally into the tube length, a plate of a ferromagnetic material to contact the winding;

inserting, laterally into the tube length, a permanent magnet to contact the opposite side of the plate from the winding; and inserting a plunger of a ferromagnetic material through the opening and inside the winding.

This method, made possible by this invention, is of special value in that it is simple and inexpensive.

Figure 2:
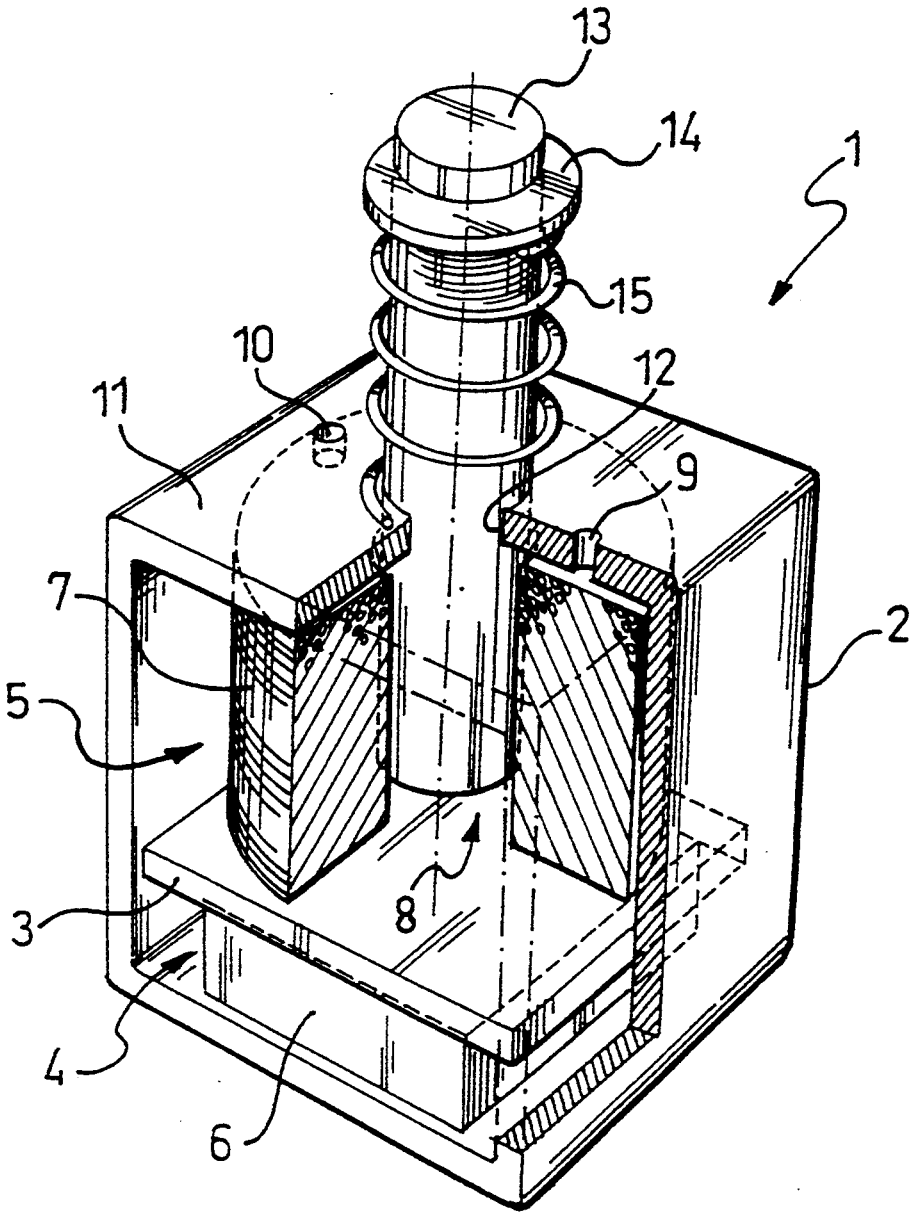

Further features and advantages of the invention will be more clearly apparent from the following detailed description of a preferred embodiment thereof, given with reference to the accompanying drawings, in which:

FIGS. 1 and 2 are perspective views showing a solenoid according to this invention at two different operational positions thereof.

In the drawing figures, generally shown at 1 is a permanent magnet release solenoid for automatic circuit breakers.

The solenoid 1 comprises a squared annular shroud which is made of a ferromagnetic material and divided theta-like by a partition 3 consisting of a flat plate, also made of an electromagnetic material; the shroud 2 and partition 3 form the stationary portion of a magnetic circuit.

The partition 3 defines two recesses 4 and 5 in the shroud which accommodate a permanent magnet 6 and an electric winding 7, respectively; both the magnet 6 and the winding 7 substantially fill their respective recesses 4 and 5, to be in contact with both the partition 3 and the shroud 2.

The winding 7 comprises an electric cable wound around a cylindrical center cavity 8; the electric cable is led out of the shroud 2 through holes 9 and 10 formed in a wall 11 of the shroud 2 remote from the partition 3.

Through this same wall 11, at a corresponding location to the cavity 8 of the winding 7, there is formed an opening 12 having substantially the same dimensions as the cavity 8.

A cylindrical plunger 13 is inserted through the opening 12 into the cavity 8 which is so dimensioned as to minimize the gap separating it from the winding 7 and—what counts more—the opening 12, and yet permit of relative sliding movement. The plunger 13 is made of a ferromagnetic material and forms the moving portion of the aforesaid magnetic circuit.

The plunger 13 protrudes out of the shroud 2, and its protruding end is provided with a washer 14 being unitary with the plunger; a coil spring 15 is fitted over the plunger 13 between the washer 14 and the shroud 2. On the opposite end, lying inside the solenoid 1, the plunger 3 is accurately machined for best magnetic coupling to the partition 3.

The plunger 3 is movable between a retracted position (shown in FIG. 1), where it would bear directly on the partition 3, and an extended position (FIG. 2) where it would be shifted outwards from the shroud 2.

In operation, the plunger 13 is normally held in the retracted position by the forces brought about by the magnetic field induced by the permanent magnet 6, against the bias of the spring 15.

When the current flowing through the winding 7 undergoes a change exceeding a set value, the magnetic field induced by the winding 7 will counteract that induced by the magnet 6, thereby the plunger 13 is pushed into its extended position by the action of the spring 15. The movement of the plunger 13 may be utilized to operate some external arrangements (not shown) such as release arrangements.

It should be noted that the plunger 13, once moved to its extended position, cannot be brought back to its retracted position by the mere action of the permanent magnet 6, because of a significant gap having established itself between the plunger 13 and the partition 3; an external mechanical resetting action will therefore be required.

This solenoid 1 can be manufactured in a uniquely straightforward and economical way by cutting the shroud 2 off a square cross-section, tubular stock, and then inserting all the elements (winding 7, partition 2, magnet 6) sideways; understandably, the opening 12 shall have to be formed first through which the plunger 13 is finally fitted.

Thus, it may be appreciated that a major economical advantage is afforded by the invention through the simple constructions of the partition 3 and the shroud 2, inherently less expensive, as well as through the ability to assemble the solenoid elements by just inserting them sideways into the shroud, one after another.

We claim:

1. A method of making a permanent magnetic release solenoid for automatic circuit breakers, comprising:

cutting off a tube length from a square cross-section stock of a ferromagnetic material, whereby said tube length comprises a single piece of ferromagnetic material;

making an opening through said tube length;

inserting, laterally into said tube length, an electric winding to a position to said opening;

inserting laterally into said tube length a flat plate of a ferromagnetic material to contact said winding;

inserting laterally into said tube length a permanent magnet to contact the opposite side of said plate from said winding; and inserting a plunger of a ferromagnetic material through said opening and inside said winding.

* * * * *